US012253295B2

(12) United States Patent
Li et al.

(10) Patent No.: US 12,253,295 B2
(45) Date of Patent: Mar. 18, 2025

(54) REFRIGERATOR WITH OBLIQUELY ARRANGED EVAPORATOR

(71) Applicants: QINGDAO HAIER REFRIGERATOR CO., LTD., Shandong (CN); HAIER SMART HOME CO., LTD., Shandong (CN)

(72) Inventors: Mengcheng Li, Qingdao (CN); Jianru Liu, Qingdao (CN); Xiaobing Zhu, Qingdao (CN); Toshinori Noda, Qingdao (CN); Hui Liu, Qingdao (CN); Yunxi Liu, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 253 days.

(21) Appl. No.: 17/772,899

(22) PCT Filed: Sep. 9, 2020

(86) PCT No.: PCT/CN2020/114257

§ 371 (c)(1),
(2) Date: Apr. 28, 2022

(87) PCT Pub. No.: WO2021/082751

PCT Pub. Date: May 6, 2021

(65) Prior Publication Data

US 2022/0373245 A1 Nov. 24, 2022

(30) Foreign Application Priority Data

Nov. 1, 2019 (CN) ..... 201921870610.1

(51) Int. Cl.
*F25D 21/14* (2006.01)
*F25D 17/06* (2006.01)

(52) U.S. Cl.
CPC ..... *F25D 21/14* (2013.01); *F25D 17/067* (2013.01)

(58) Field of Classification Search
CPC ..... F25D 21/14; F25D 17/067
See application file for complete search history.

(56) References Cited

U.S. PATENT DOCUMENTS 2,767,558 A 10/1956 Wallenbrock et al.
2,909,910 A * 10/1959 Saunders ..... F25D 21/14 62/277

(Continued)

FOREIGN PATENT DOCUMENTS

CN 2671439 Y 1/2005
CN 1611876 A 5/2005

(Continued)

OTHER PUBLICATIONS

International Search Report and Written Opinion for PCT/CN2020/114257 mailed Dec. 7, 2020 (12 pages).

(Continued)

*Primary Examiner* — Ana M Vazquez
(74) *Attorney, Agent, or Firm* — ALSTON & BIRD LLP

(57) ABSTRACT

A refrigerator, including a cabinet in which a cooling chamber located at the lower part and at least one storage compartment located above the cooling chamber are defined; and an evaporator arranged in the cooling chamber and configured to cool airflow entering the cooling chamber to form cooling airflow, wherein a water pan is formed on a bottom wall of the cooling chamber below the evaporator, and used for receiving defrosted water generated by the evaporator, a slope structure is formed on an upper surface of the water pan, and the evaporator is obliquely arranged on the water pan. According to the refrigerator, the effective (Continued)

volume of the compartment is increased, and the overall height of the cooling chamber can be reduced.

4 Claims, 5 Drawing Sheets

(56) References Cited

U.S. PATENT DOCUMENTS

| | | | |
|---|---|---|---|
| 3,433,031 | A | 3/1969 | Scheitlin et al. |
| 2018/0156527 | A1 | 6/2018 | Coemert et al. |
| 2019/0142185 | A1 | 5/2019 | Bates et al. |

FOREIGN PATENT DOCUMENTS

| | | | | |
|---|---|---|---|---|
| CN | 102494465 | A | | 6/2012 |
| CN | 202562164 | U | | 11/2012 |
| CN | 208475771 | U | | 2/2019 |
| CN | 208688069 | U | | 4/2019 |
| CN | 208817797 | U | | 5/2019 |
| CN | 208817799 | U | | 5/2019 |
| CN | 211372884 | U | | 8/2020 |
| CN | 112129033 | A | * | 12/2020 |
| EP | 1135658 | B1 | | 11/2005 |
| GB | 895548 | A | | 5/1962 |
| JP | H0882468 | A | * | 3/1996 |
| JP | 09189460 | A | | 7/1997 |

OTHER PUBLICATIONS

Notice of Acceptance for Australia Patent Application No. 2020373770 dated May 8, 2023 (3 pages).

1st Examination Report of Australia Patent Application No. 2020373770 dated Dec. 21, 2022 (3 pages).

Notification of Intent to Grant China Patent Application No. 201921870610.1 dated Jan. 25, 2021 (2 pages).

Notification of Intent to Grant EP Patent Application No. 20882878.0 dated Jan. 24, 2023 (29 pages).

Search Report of EP Patent Application No. 20882878.0 dated Aug. 11, 2022 (4 pages).

1st Office Action of EP Patent Application No. 20882878.0 dated Aug. 23, 2022 (5 pages).

* cited by examiner

REFRIGERATOR WITH OBLIQUELY ARRANGED EVAPORATOR

CROSS-REFERENCE TO RELATED APPLICATIONS

The present application is a national phase entry of International Application No. PCT/CN2020/114257, filed Sep. 9, 2020, which claims priority to Chinese Application No. 201921870610.01, filed Nov. 1, 2019, which are each incorporated herein by reference in their entirety.

FIELD OF THE INVENTION

The present invention relates to the technical field of refrigeration and freezing devices, and in particular relates to a refrigerator.

BACKGROUND OF THE INVENTION

In an existing refrigerator, a freezing compartment is generally located at the lower part of the refrigerator, a cooling chamber is located at the rear part of the outer side of the freezing compartment, a compressor chamber is located behind the freezing compartment, and the freezing compartment needs to give way for the compressor chamber, so that the freezing compartment is in a special shape, and the depth of the freezing compartment is limited.

BRIEF DESCRIPTION OF THE INVENTION

The present invention aims to provide a refrigerator which has large effective compartment volume and simple cabinet structure and is easy to form through foaming.

The present invention further aims to provide a refrigerator which is convenient to discharge water.

Specifically, the present invention provides a refrigerator, including:

a cabinet in which a cooling chamber located at the lower part and at least one storage compartment located above the cooling chamber are defined; and an evaporator arranged in the cooling chamber and configured to cool an airflow entering the cooling chamber to form a cooling airflow, wherein a water pan is formed on a bottom wall of the cooling chamber below the evaporator, and used for receiving defrosted water generated by the evaporator, a slope structure is formed on an upper surface of the water pan, and the evaporator is obliquely arranged on the water pan.

Optionally, a water outlet is formed in a tail end of a lower part of the slope structure of the water pan.

Optionally, the water pan is formed by the bottom wall, inclining downwards from front to rear, of the cooling chamber, and the water outlet is close to a compressor chamber of the refrigerator.

Optionally, an included angle between the water pan and the horizontal plane is 3°-45°.

Optionally, the refrigerator further includes at least one air supply fan configured to cause an airflow to flow within the cooling chamber and located upstream and/or downstream of the evaporator on an airflow flowing path.

Optionally, the air supply fan is configured to be located downstream of the evaporator on the airflow flowing path.

Optionally, an inclined section is formed on the bottom wall of the cooling chamber below the air supply fan; and the water outlet is formed in the joint of the inclined section and the water pan.

Optionally, the evaporator is wholly obliquely arranged on the water pan in the shape of a flat cube, and is configured such that the long edge of the cross section of the evaporator is parallel to a rear wall of the cabinet, and the short edge of the cross section of the evaporator is perpendicular to the rear wall of the cabinet.

Optionally, at least one return air inlet in communication with the at least one storage compartment is formed in the front side of the cooling chamber; and the refrigerator further includes an air supply duct, return airflow of the storage compartment flows through the return air inlet to enter the cooling chamber to be cooled, and the cooling airflow flows into the storage compartment through the air supply duct.

Optionally, the at least one storage compartment includes a freezing compartment positioned above the cooling chamber; and the air supply duct is formed at a rear wall of the freezing compartment, return airflow of the freezing compartment flows through the return air inlet and enters the cooling chamber to be cooled by the evaporator, and the cooling airflow flows into the freezing compartment through the air supply duct.

According to the refrigerator provided by the present invention, due to the fact that the evaporator is arranged at the bottom, the effective volume of the compartment is increased; the water pan with the slope structure on the upper surface is formed on the bottom wall of the cooling chamber below the evaporator, the evaporator is obliquely arranged on the water pan, and the water pan receives the defrosted water generated by the evaporator, so that the defrosted water can be discharged in time; the water pan is simple in structure, so that the cabinet is easy to form through foaming; and meanwhile, the evaporator is obliquely arranged, so that the overall height of the cooling chamber can be reduced, and the effective volume of the compartment is further increased.

Furthermore, the water pan of the refrigerator provided by the present invention is formed by the bottom wall, inclining downwards from front to rear, of the cooling chamber, and the water outlet is close to the compressor chamber of the refrigerator, so that the distance between the water outlet and an evaporating dish in the compressor chamber is shortened, and the water is more convenient to discharge.

Furthermore, the refrigerator provided by the present invention is provided with the air supply fan, so that the airflow can be promoted to flow in the cooling chamber.

The above, as well as other objectives, advantages, and characteristics of the present invention, will be better understood by those skilled in the art according to the following detailed description of specific embodiments of the present invention taken in conjunction with the accompanying drawings.

BRIEF DESCRIPTION OF THE DRAWINGS

In the following part, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In figures.

DETAILED DESCRIPTION

Figure 1:
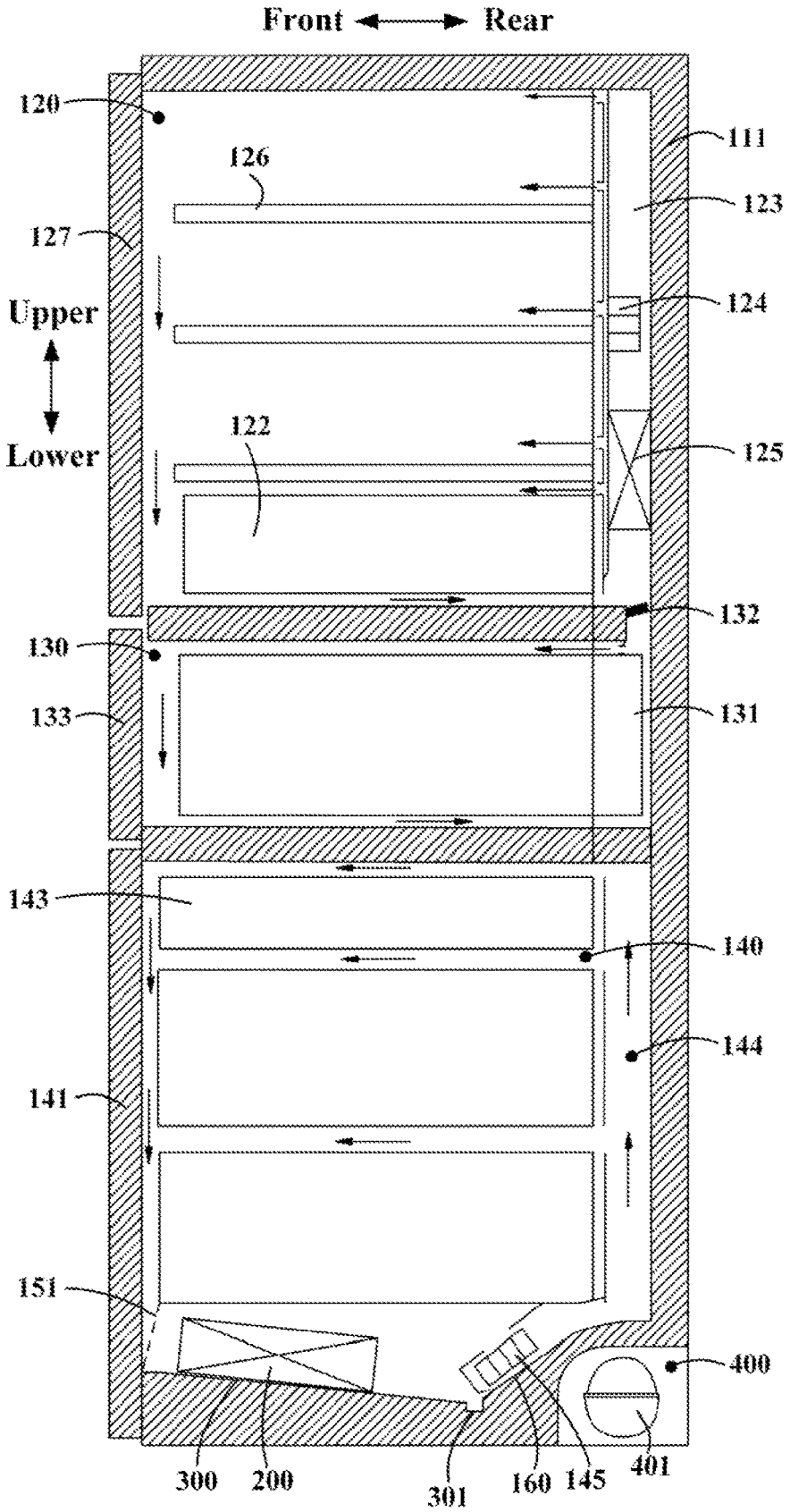
FIG. 1 is a schematic lateral cross-sectional view of a refrigerator according to an embodiment of the present invention.
Figure 2:
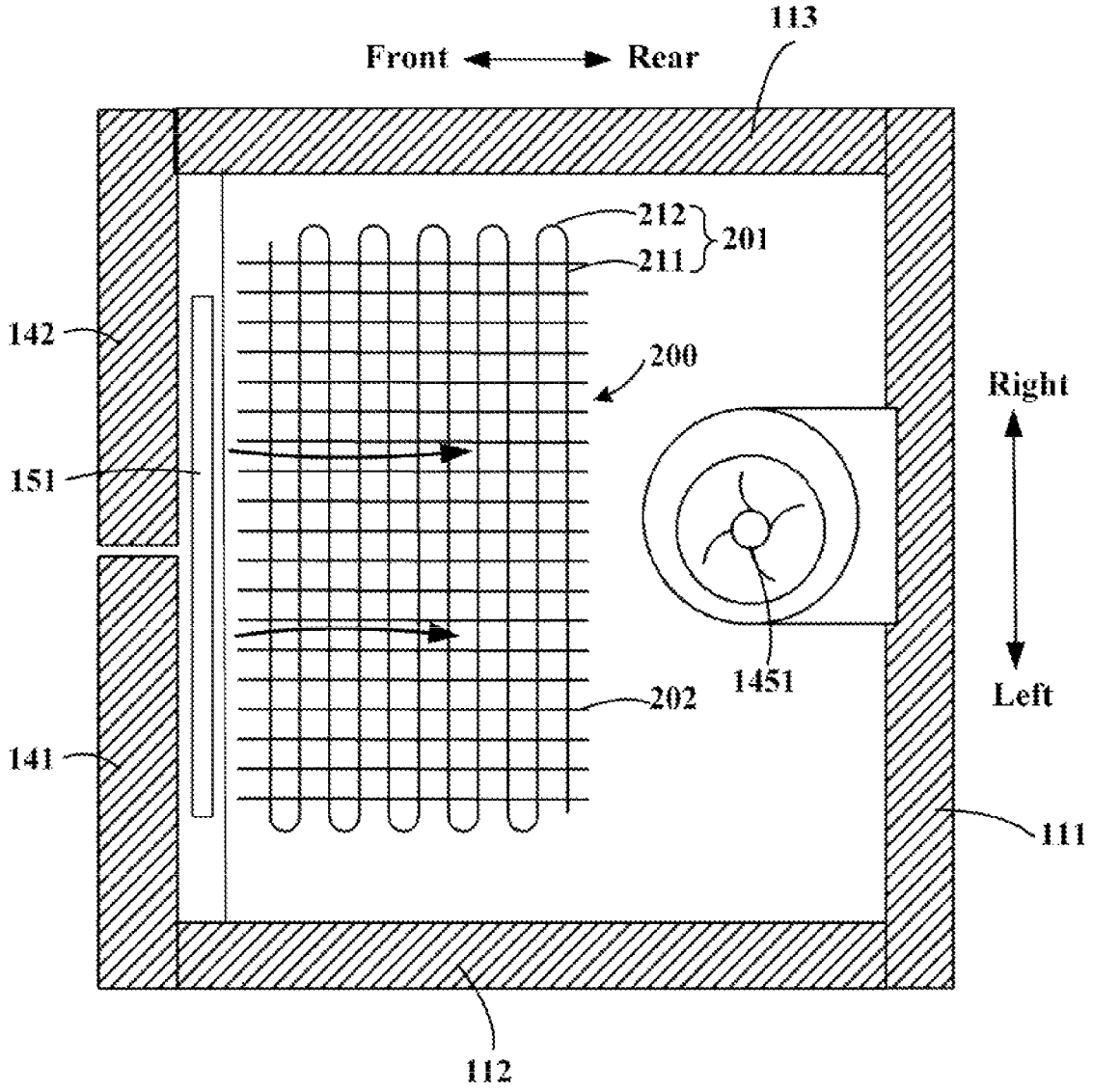
FIG. 2 is a schematic cross-sectional view of one implementation of a cooling chamber of the refrigerator shown in FIG. 1.
Figure 3:
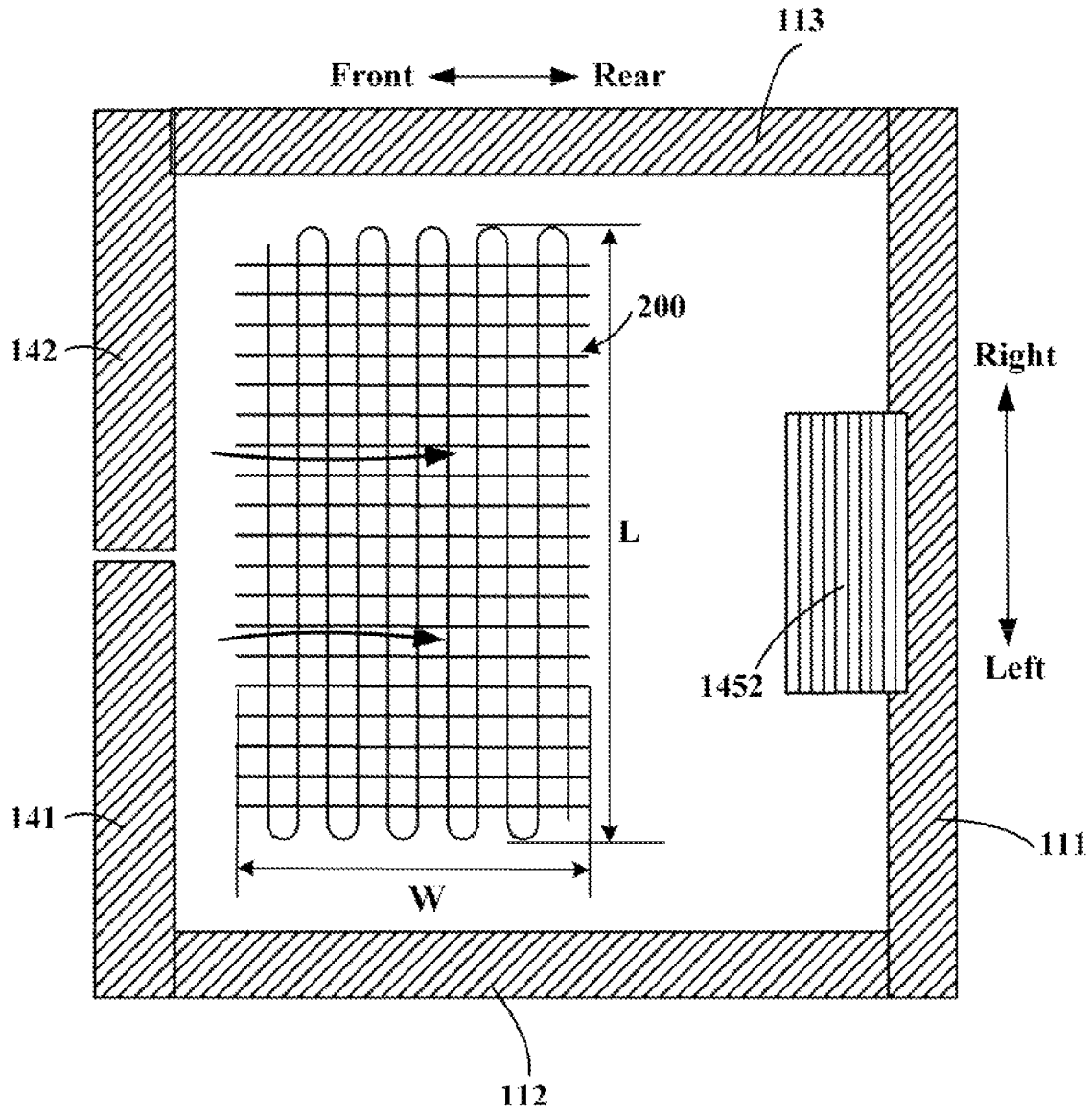
FIG. 3 is a schematic cross-sectional view of another implementation of a cooling chamber of the refrigerator shown in FIG. 1.
Figure 4:
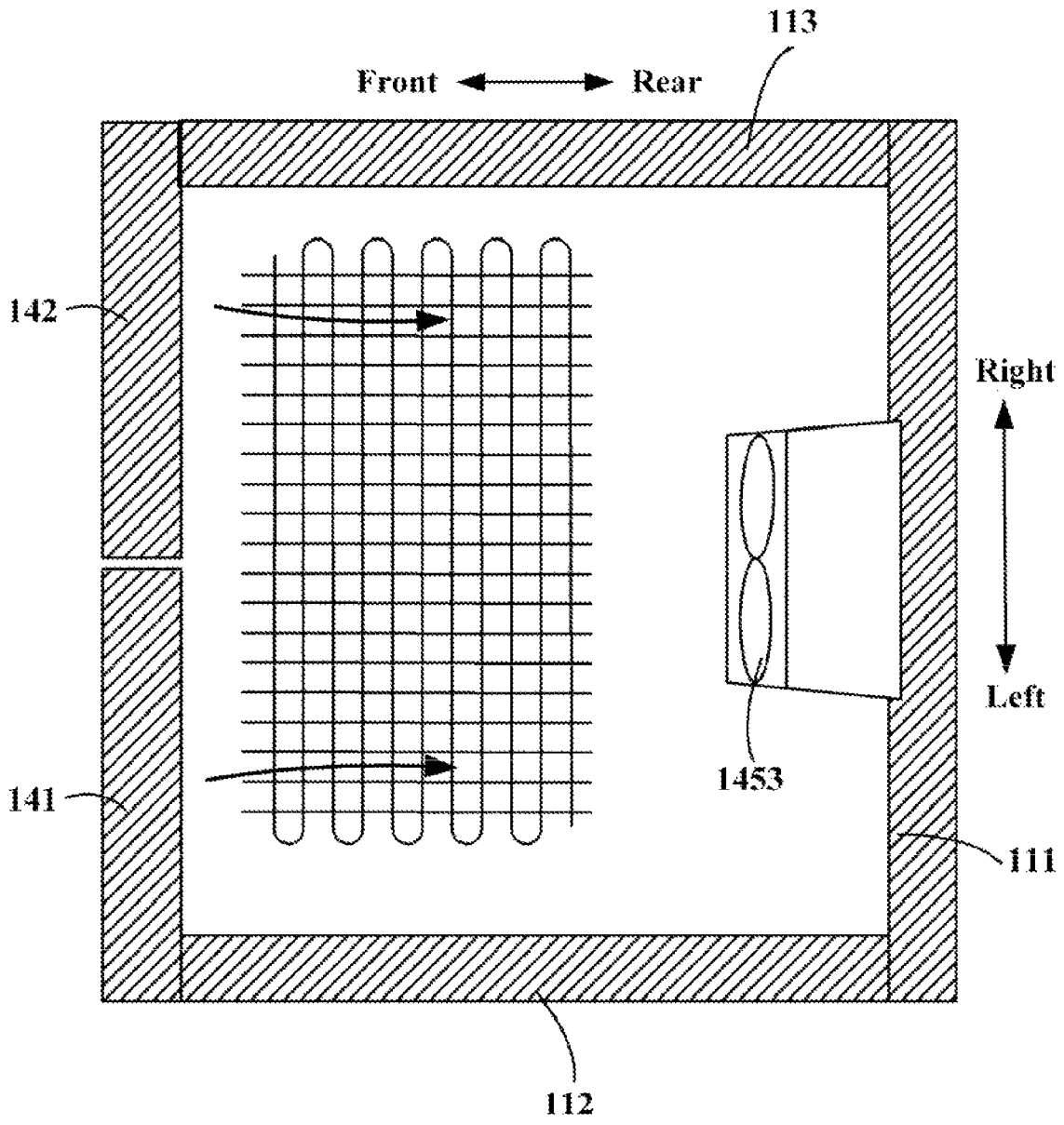
FIG. 4 is a schematic cross-sectional view of yet another implementation of a cooling chamber of the refrigerator shown in FIG. 1.

FIG. 1 is a schematic lateral cross-sectional view of a refrigerator 100 according to an embodiment of the present invention. FIG. 2 is a schematic cross-sectional view of one implementation of a cooling chamber 150 of the refrigerator 100 shown in FIG. 1. FIG. 3 is a schematic cross-sectional view of another implementation of a cooling chamber 150 of the refrigerator 100 shown in FIG. 1. FIG. 4 is a schematic cross-sectional view of yet another implementation of a cooling chamber 150 of the refrigerator 100 shown in FIG. 1. In the description below, orientation or position relations indicated by the terms "front", "rear", "upper", "lower", "left", "right" and the like are orientations based on the refrigerator 100 itself as a reference, such as directions indicated in FIG. 1 and FIG. 2.

A refrigerator 100 provided by the embodiment of the present invention generally includes a cabinet 110 and an evaporator 200, the cabinet 110 includes a housing and a storage liner arranged on the inner side of the housing, a space between the housing and the storage liner is filled with a thermal insulation material (forming a foamed layer), and a storage compartment is defined in the storage liner. The cabinet 110 is provided with a top wall, a left side wall 112, a right side wall 113 and a rear wall 111, and a cooling chamber 150 located at the lower part and at least one storage compartment located above the cooling chamber 150 are defined in the cabinet. The evaporator 200 is arranged in the cooling chamber 150 and configured to cool an airflow entering the cooling chamber 150 to form a cooling airflow. A water pan 300 is formed on a bottom wall of the cooling chamber 150 below the evaporator 200, and used for receiving defrosted water generated by the evaporator 200, a slope structure is formed on an upper surface of the water pan 300, and the evaporator 200 is obliquely arranged on the water pan 300. According to the refrigerator 100 provided by the present invention, due to the fact that the evaporator 200 is arranged at the bottom, the effective volume of the compartment is increased; the water pan 300 with the slope structure on the upper surface is formed on the bottom wall of the cooling chamber 150 below the evaporator 200, the evaporator 200 is obliquely arranged on the water pan 300, and the water pan 300 receives the defrosted water generated by the evaporator 200, so that the defrosted water can be discharged in time; the water pan 300 is simple in structure, so that the cabinet 110 is easy to form through foaming; and meanwhile, the evaporator 200 is obliquely arranged, so that the overall height of the cooling chamber 150 can be reduced, and the effective volume of the compartment is further increased.

In some embodiments, a water outlet 301 is formed in the tail end of a lower part of the slope structure of the water pan 300.

In some embodiments, the water pan 300 is formed by the bottom wall, inclining downwards from front to rear, of the cooling chamber 150, and the water outlet 301 is close to a compressor chamber 400 of the refrigerator 100. The water pan 300 of the refrigerator 100 provided by the present invention is formed by the bottom wall, inclining downwards from front to rear, of the cooling chamber 150, and the water outlet 301 is close to the compressor chamber 400 of the refrigerator 100, so that the distance between the water outlet 301 and an evaporating dish in the compressor chamber 400 is shortened, and the water is more convenient to discharge. An included angle between the water pan 300 and the horizontal plane is 3°-45°, such as 6°, 8°, 10°, 30° and 40°.

In some embodiments, the refrigerator 100 further includes at least one air supply fan 145 configured to cause an airflow to flow within the cooling chamber 150 and located upstream and/or downstream of the evaporator 200 on an airflow flowing path. According to the refrigerator 100 provided by the present invention, the air supply fan 145 is arranged, so that the airflow can be promoted to flow in the cooling chamber 150. As shown in FIG. 2, FIG. 3, and FIG. 4, the air supply fan 145 is preferably configured to be located downstream of the evaporator 200 on the airflow flowing path and an air outlet is in communication with an air supply duct 144. In the embodiment shown in FIG. 2, the air supply fan 145 is a centrifugal fan 1451. In the embodiment shown in FIG. 3, the air supply fan 145 is a cross-flow fan 1452. In the embodiment shown in FIG. 4, the air supply fan 145 is an axial flow fan 1453. The air supply fan 145 is arranged downstream of the evaporator 200, so that the airflow cooled by the evaporator 200 can be accelerated to flow towards the storage compartment, and the refrigerating effect of the refrigerator 100 is guaranteed.

In some embodiments, an inclined section 160 is formed on the bottom wall of the cooling chamber 150 below the air supply fan 145, and the water outlet 301 is formed in the joint of the inclined section 160 and the water pan 300. The air supply fan 145 is arranged on the inclined section 160, so that the influence of the defrosted water on the air supply fan 145 can be avoided; and meanwhile, the air supply fan 145 has a special design structure, so that the air loss can be reduced, and the air supply efficiency is guaranteed.

In some embodiments, the evaporator 200 is wholly obliquely arranged on the water pan 300 in the shape of a flat cube, and is configured such that the long edge of the cross section of the evaporator is parallel to the rear wall 111 of the cabinet 110, and the short edge of the cross section of the evaporator is perpendicular to the rear wall 111 of the cabinet 110. In a preferred embodiment, the evaporator 200 is provided with a coil 201 and a plurality of fins 202 arranged on the coil 201 in a sleeving manner. The coil 201 is provided with a plurality of first sections 211 arranged in parallel and second sections 212 connecting the adjacent first sections 211, the coil 201 is bent in a reciprocating mode, and a through-cavity allowing a refrigerant to flow through is formed in the coil. The fins 202 are perpendicular to the first sections 211, and airflow passages are defined between the adjacent fins 202. The flow direction of the airflow in the evaporator 200 is shown in FIG. 2 with bold arrows.

In some embodiments, at least one return air inlet 151 in communication with the at least one storage compartment is formed in the front side of the cooling chamber 150. In order to illustrate a flowing path of the airflow in FIG. 2, the return air inlet 151 is schematically shown. The refrigerator 100 further includes an air supply duct 144, an air outlet of the air supply fan 145 being in communication with the air supply duct 144. A return airflow of the storage compartment enters the cooling chamber 150 through the return air inlet 151 to be cooled, and the cooling airflow flows into the storage compartment through the air supply duct 144.

The refrigerator 100 of the present invention is described in detail below in connection with FIG. 1. Herein, for convenience of description, the evaporator arranged within the cooling chamber 150 is shown with reference numeral 200, while the evaporator, which is not arranged within the cooling chamber 150, is named and numbered based on the storage compartment into which the cooling airflow formed by the evaporator flows, such as a refrigerating evaporator 125.

In the embodiment shown in FIG. 1, the refrigerator 100 generally includes a cabinet 110, a first door body 127, a second door body 133, a first freezing door body 141, a second freezing door body 142, a refrigerating air supply fan 124, a refrigerating evaporator 125, an evaporator 200 and an air supply fan 145. A cooling chamber 150 is defined by the cabinet 110 of the refrigerator 100, and the evaporator 200 is arranged in the cooling chamber 150. Storage compartments include a refrigerating compartment 120, a variable-temperature compartment 130 and a freezing compartment 140 which are sequentially arranged from top to bottom. The freezing compartment 140 is located above the cooling chamber 150. The first door body 127 is arranged on the front side of the refrigerating compartment 120 to open or close the refrigerating compartment 120. A plurality of separators 126 are arranged inside the refrigerating compartment 120, to divide the refrigerating compartment 120 into several parts, and a refrigerating drawer 122 is also arranged below the lowermost separator 126. A refrigerating air supply duct 123 is formed at the rear wall 111 of the refrigerating compartment 120. The refrigerating air supply duct 123 is provided with a refrigerating air supply outlet in communication with the refrigerating compartment 120, and the refrigerating air supply fan 124 and the refrigerating evaporator 125 are arranged in the refrigerating air supply duct 123. A variable-temperature drawer 131 is arranged in the variable-temperature compartment 130, and the second door body 133 is arranged on the front side of the variable-temperature compartment to open or close the variable-temperature compartment 130. The rear wall 111 of the variable-temperature compartment 130 is in communication with the refrigerating air supply duct 123, and a variable-temperature air door 132 is arranged between the rear wall and the refrigerating air supply duct. The variable-temperature air door 132 is opened at an angle when the cooling airflow needs to be transmitted into the variable-temperature compartment 130. The first freezing door body 141 and the second freezing door body 142 are arranged on the front side of the freezing compartment 140, and freezing drawers 143 are defined in the freezing compartment. At least one return air inlet 151 in communication with the freezing compartment 140 is formed in the front side of the cooling chamber 150. An air supply duct 144 in communication with the cooling chamber 150 and the freezing compartment 140 is formed at the rear wall 111 of the cabinet 110 of the freezing compartment 140, so that return airflow of the freezing compartment 140 flows through the return air inlet 151 to enter the cooling chamber 150 to be cooled by the evaporator 200, and the cooling airflow flows into the freezing compartment 140 through the air supply duct 144. As is well known to those skilled in the art, the temperature of the refrigerating compartment 120 is generally between 2° C. and 10° C., preferably 4° C. to 7° C. The temperature of the freezing compartment 140 is generally between −22° C. and −14° C. The variable-temperature compartment 130 can be adjusted to −18° C. to 8° C. at will. Optimal storage temperatures for different types of articles are different, and suitable locations for storage are also different, for example, fruits and vegetables are suitable for storage in the refrigerating compartment 120, while meat is suitable for storage in the freezing compartment 140. It should be understood that the airflow cooled by the evaporator 200 may also be provided to the refrigerating compartment 120 and/or the variable-temperature compartment 130 with corresponding modifications to the air supply ducts of these. For example, the bottom end of the refrigerating air supply duct 123 is in communication with the top end of the air supply duct 144, and an air door is arranged at the joint of them to control the flow of air.

In the refrigerator 100 shown in FIG. 1, a water pan 300 is formed by the bottom wall, inclining downward from front to rear, of the cooling chamber 150 below the evaporator 200. For example, an included angle between the water pan 300 and the horizontal plane is 6°. The evaporator 200 is wholly obliquely arranged on the water pan 300 in the shape of a flat cube, and provided with a coil 201 and a plurality of fins 202 arranged on the coil 201 in a sleeving manner. The coil 201 is provided with a plurality of first sections 211 arranged in parallel and second sections 212 connecting the adjacent first sections 211. The fins 202 are perpendicular to the first sections 211, and airflow passages are defined between the adjacent fins 202. The first sections 211 of the evaporator 200 are parallel to the rear wall 111 and the fins 202 are perpendicular to the rear wall 111. More preferably, the length L of the long edge of the rectangular cross-section of the evaporator 200 is 1.5-2.0 times the length W of the short edge thereof, such as 1.5 times, 1.7 times and 2.0 times, as shown in FIG. 3. The air supply fan 145 is configured to be located downstream of the evaporator 200 on an airflow flowing path, and its air outlet is in communication with the air supply duct 144. An inclined section 160 is formed on the bottom wall of the cooling chamber 150 below the air supply fan 145, and a water outlet 301 is formed in the joint of the inclined section 160 and the water pan 300. For example, an included angle between the inclined section 160 and the horizontal plane is 45°.

Figure 5:
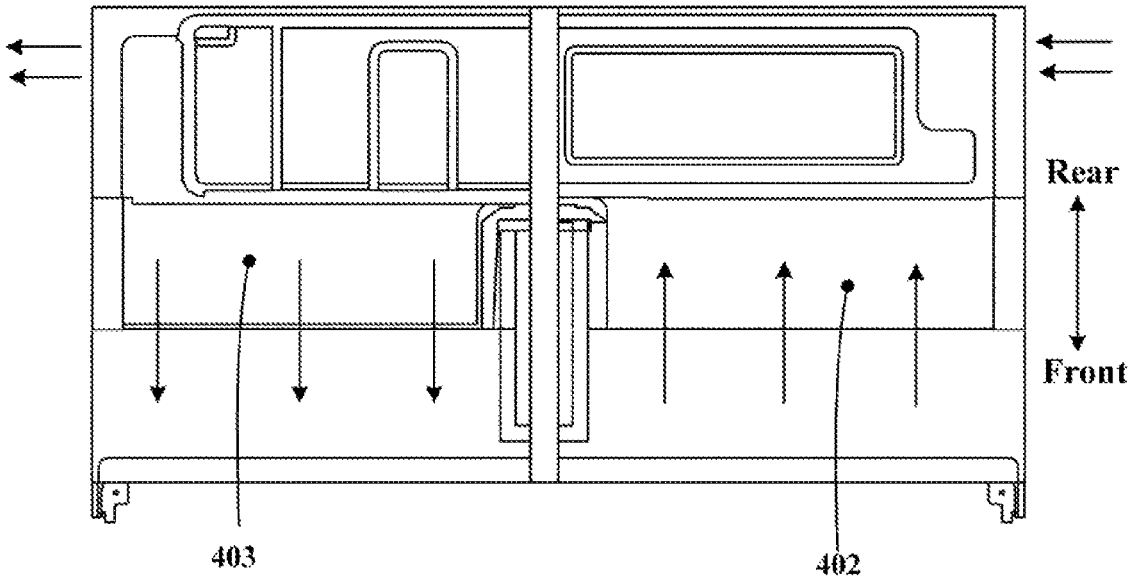
FIG. 5 is a schematic bottom view of the refrigerator shown in FIG. 1.

FIG. 5 is a schematic bottom view of a refrigerator 100 according to an embodiment of the present invention. A compressor chamber 400 is defined at the bottom of a cabinet 110 of the refrigerator 100 of the embodiment of the present invention, and the compressor chamber 400 is located behind a cooling chamber 150, so that the compressor chamber 400 is wholly located below a freezing compartment 140, thus as previously, the freezing compartment 140 does not need to give way for the compressor chamber 400, the depth of the freezing compartment 140 is guaranteed, and articles which are large in size and not easy to be divided can be conveniently placed. A refrigerating system of the refrigerator 100 is a compression refrigerating system and includes a compressor 401, a heat dissipation fan and a condenser. The heat dissipation fan may be an axial flow fan. The compressor 401, the heat dissipation fan and the condenser are sequentially arranged in the compressor chamber 400 at intervals in a transverse direction. There are two general design ideas for air feeding and discharging of the compressor chamber 400 by those skilled in the art. One is that a rear air inlet facing the condenser and a rear air outlet facing the compressor 401 are formed in the rear wall 111 of the compressor chamber 400, and circulation of heat dissipation airflow is completed at the rear wall 111 of the compressor chamber 400. The other is that ventilation holes are formed in a front wall and the rear wall 111 of the compressor chamber 400 to form a heat dissipation circulating air path in the front-rear direction. When the heat dissipation effect of the compressor chamber 400 needs to be increased, those skilled in the art generally increase the number of the rear air inlets and the rear air outlets in the rear wall 111 of the compressor chamber 400 to increase the ventilation area, or increase the heat exchange area of the condenser, for example, using a U-shaped condenser with a larger heat exchange area. The inventors creatively recognized that the heat exchange area of the condenser and the ventilation area of the compressor chamber 400 are not as larger as better, and in a conventional design scheme of increasing the heat exchange area of the condenser and the ventilation area of the compressor chamber 400, the problem of non-uniform heat dissipation of the condenser is caused, and adverse effects are generated on the refrigerating system of the refrigerator 100. Therefore, a bottom air inlet 402 close to the condenser and a bottom air outlet 403 close to the compressor 401 arranged in a transverse direction on the bottom wall of the cabinet 110 as proposed in the present invention, so that circulation of the heat dissipation airflow is completed at the bottom of the refrigerator 100, and the distance between the rear wall 111 of the cabinet 110 and a cupboard does not need to be increased. Good heat dissipation of the compressor chamber 400 is guaranteed while the occupied space of the refrigerator 100 is reduced, so that the problem that heat dissipation and space occupation of the compressor chamber 400 of an embedded refrigerator 100 cannot be balanced is fundamentally solved, which is of particularly important significance. The heat dissipation fan is configured to promote ambient air around the bottom air inlet 402 to enter the compressor chamber 400 from the bottom air inlet 402, then flow through the condenser and the compressor 401, and finally flow to the ambient environment through the bottom air outlet 403, so that the heat of the compressor 401 and the condenser are dissipated. In addition, support rollers may also be arranged at four corners of the bottom wall of the cabinet 110, the cabinet 110 is placed on a supporting surface through the four support rollers, and a certain space is formed between the bottom wall of the cabinet 110 and the supporting surface.

According to the refrigerator 100 provided by the embodiment of the present invention, due to the fact that the evaporator 200 is arranged at the bottom, the effective volume of the compartment is increased; the water pan 300 with the slope structure on the upper surface is formed on the bottom wall of the cooling chamber 150 below the evaporator 200, the evaporator 200 is obliquely arranged on the water pan 300, and the water pan 300 receives the defrosted water generated by the evaporator 200, so that the defrosted water can be discharged in time; the water pan 300 is simple in structure, so that the cabinet 110 is easy to form through foaming; and meanwhile, the evaporator 200 is obliquely arranged, which can reduce the overall height of the cooling chamber 150, and further increase the effective volume of the compartment.

Furthermore, the water pan 300 of the refrigerator 100 provided by the embodiment of present invention is formed by the bottom wall, inclining downwards from front to rear, of the cooling chamber 150, and the water outlet 301 is close to the compressor chamber 400 of the refrigerator 100, so that the distance between the water outlet 301 and an evaporating dish in the compressor chamber 400 is shortened, and the water is more convenient to discharge.

Furthermore, according to the refrigerator 100 provided by the embodiment of the present invention, the air supply fan 145 is arranged, so that the airflow can be promoted to flow in the cooling chamber 150.

Hereto, those skilled in the art should realize that although a plurality of exemplary embodiments of the present invention have been shown and described in detail herein, without departing from the spirit and scope of the present invention, many other variations or modifications that conform to the principles of the present invention can still be directly determined or deduced from the contents disclosed in the present invention. Therefore, the scope of the present invention should be understood and recognized as covering all these other variations or modifications.

The invention claimed is:

1. A refrigerator, comprising:

a cabinet in which a cooling chamber located at a lower part and at least one storage compartment located above the cooling chamber are defined;

an evaporator arranged in the cooling chamber and configured to cool an airflow entering the cooling chamber to form a cooling airflow, wherein a water pan is formed on a bottom wall of the cooling chamber below the evaporator, and used for receiving defrosted water generated by the evaporator, a slope structure is formed on an upper surface of the water pan, and the evaporator is obliquely arranged on the water pan; and at least one air supply fan disposed in the cooling chamber and completely below the storage compartment, the air supply fan being configured to cause an airflow to flow within the cooling chamber and located downstream of the evaporator on an airflow flowing path, wherein a water outlet is formed in a tail end of a lower part of the slope structure of the water pan, wherein the water pan is formed by the bottom wall, inclining downwards from front to rear, of the cooling chamber, and the water outlet is close to a compressor chamber of the refrigerator, wherein an inclined section is formed on the bottom wall of the cooling chamber below the air supply fan, the air supply fan being arranged on the inclined section, and the inclined section and the air supply fan wholly inclining upwards from front to rear, and the water outlet is formed in a joint of the inclined section and the water pan, wherein the evaporator is wholly obliquely arranged on the water pan in the shape of a flat box, and is configured such that a long edge of a cross section of the evaporator is parallel to a rear wall of the cabinet, and a short edge of the cross section of the evaporator is perpendicular to the rear wall of the cabinet.

2. The refrigerator according to claim 1, wherein an included angle between the water pan and the horizontal plane is between 3° and 45°.

3. The refrigerator according to claim 1, wherein at least one return air inlet in communication with the at least one storage compartment is formed in a front side of the cooling chamber; and the refrigerator further includes an air supply duct, a return airflow of the storage compartment flows through the return air inlet to enter the cooling chamber to be cooled, and the cooling airflow flows into the storage compartment through the air supply duct.

4. The refrigerator according to claim 3, wherein the at least one storage compartment includes a freezing compartment located above the cooling chamber; and the air supply duct is formed at a rear wall of the freezing compartment, the return airflow of the freezing compartment flows through the return air inlet and enters the cooling chamber to be cooled by the evaporator, and the cooling airflow flows into the freezing compartment through the air supply duct.

* * * * *